US007357009B2

(12) United States Patent
Maloney et al.

(10) Patent No.: US 7,357,009 B2
(45) Date of Patent: Apr. 15, 2008

(54) PEDASTAL CLOSURE ASSEMBLY HAVING SNAG-FREE LOCK

(75) Inventors: Jerome A. Maloney, Sugar Grove, IL (US); Albert McGovern, Naperville, IL (US)

(73) Assignee: Emerson Network Power, Energy Systems, North America, Inc., Warrenville, IL (US)

( * ) Notice: Subject to any disclaimer, the term of this patent is extended or adjusted under 35 U.S.C. 154(b) by 0 days.

(21) Appl. No.: 10/712,226

(22) Filed: Nov. 13, 2003

(65) Prior Publication Data

US 2005/0103067 A1 May 19, 2005

(51) Int. Cl.
*B65D 55/14* (2006.01)

(52) U.S. Cl. ..... 70/169; 70/163; 174/135; 292/169; 220/4.02; 220/210; 220/484

(58) Field of Classification Search ..... 70/166–173; 292/169; 248/551–553; 312/100, 284; 174/37–39, 58, 135; 220/475, 4.02, 484, 220/210, 4.21, 4.25
See application file for complete search history.

(56) References Cited

U.S. PATENT DOCUMENTS

| | | | | | |
|---|---|---|---|---|---|
| 1,267,284 | A | * | 5/1918 | Shanahan | 220/247 |
| 1,538,219 | A | * | 5/1925 | Shanahan | 70/169 |
| 1,788,118 | A | * | 1/1931 | Meyer | 70/168 |
| 1,853,427 | A | * | 4/1932 | Hollister | 70/173 |
| 3,261,186 | A | * | 7/1966 | Laviana | 70/116 |
| 3,812,279 | A | * | 5/1974 | Voegeli | 174/38 |
| 4,732,417 | A | * | 3/1988 | Yang | 292/142 |
| 4,866,963 | A | * | 9/1989 | Leininger et al. | 70/278.2 |
| 5,007,258 | A | * | 4/1991 | Mahaney | 70/159 |
| 5,275,028 | A | | 1/1994 | Girrante | 70/56 |
| 5,301,989 | A | * | 4/1994 | Dallmann et al. | 292/142 |
| 5,345,795 | A | | 9/1994 | James et al. | |
| 5,412,960 | A | | 5/1995 | James et al. | |
| 5,450,737 | A | | 9/1995 | Sasaki | 70/346 |
| 5,666,830 | A | * | 9/1997 | Litvin | 70/129 |
| 5,697,238 | A | | 12/1997 | Oike | 70/373 |
| 5,722,707 | A | * | 3/1998 | Hosoi | 292/258 |
| 6,152,497 | A | * | 11/2000 | Vickers et al. | 292/34 |
| 6,302,453 | B1 | | 10/2001 | Norton | 292/169.21 |

(Continued)

FOREIGN PATENT DOCUMENTS

| | | |
|---|---|---|
| DE | 89 13 164 U1 | 1/1990 |

*Primary Examiner*—Lloyd A. Gall
(74) *Attorney, Agent, or Firm*—Harness, Dickey & Pierce, P.L.C.

(57) ABSTRACT

A quarter turn slide lock assembly having a base, a cover, a slider, a rotator, springs and washers. The base includes a channel for the slider to move between extended and retracted positions. The slider includes internal and exterior cam follower surfaces. The rotator has a hex head for 90° rotation by a special tool and a cam arm for engaging the internal cam follower surface of the slider. The external cam follower surface is biased by an abutting surface on an object to be locked and the springs bias the slider in an opposite direction to an interference fit with the object. The base includes a smooth, slanted outer surface to avoid snags and the washers reinforce the slide lock so that rivets used to attach the slide lock to an object to be locked are strongly secured. The cover snap fits to the base for a simple and reliable slide lock assembly.

22 Claims, 5 Drawing Sheets

U.S. PATENT DOCUMENTS 6,375,234 B1 4/2002 Brackmann et al. ..... 292/1
6,735,992 B2 * 5/2004 Hauer et al. ..... 70/167
6,742,365 B1 * 6/2004 Sullivan et al. ..... 70/2

* cited by examiner

PEDASTAL CLOSURE ASSEMBLY HAVING SNAG-FREE LOCK

CROSS REFERENCE TO RELATED APPLICATIONS

Not applicable.

STATEMENT REGARDING FEDERALLY SPONSORED RESEARCH

Not applicable.

BACKGROUND OF THE INVENTION

1. Field of the Invention

The present application relates to a quarter turn slide lock assembly and more particularly to an inexpensive, corrosive resistant quarter turn slide lock assembly suitable for outdoor use.

2. Description of the Related Art

There are devices that require inexpensive, corrosive resistant locks to prevent most forms of vandalism. For example, outdoor telecommunication pedestals are exposed to environmental hazards including rain, flood, winds, contaminants and the like as well as attempted tampering and vandalism. Such pedestals are now economically made of synthetic resin material. For security reasons these pedestals are locked to prevent unauthorized entry but from time to time the pedestals may be opened for service by an authorized technician. Examples of existing lock structures are disclosed in U.S. Pat. Nos. 5,345,795 and 5,412,960.

Hence, a reliable, inexpensive and secure lock for harsh environmental conditions is very desirable.

BRIEF SUMMARY OF THE INVENTION

What is described here is a slide lock assembly comprising a base having a channel formed therein, a slider mounted in the channel of the base and movable along the channel between an extended position and a retracted position, a rotator mounted to the base and connected to the slider for moving the slider to its retracted position upon rotation of about ninety degrees (a quarter turn), and a biasing element mounted between the base and the slider for pushing the slider to its extended position.

There are a number of advantages, features and objects achieved with the present invention which are believed not to be available in earlier related devices. For example, the slide lock assembly of the present disclosure has an automatic locking feature, is automatically operated by cam action and needs only a quarter turn to open. The slide lock assembly disclosed here is compact with a smooth outer surface so as not to snag or interfere with wires or the like if there is a need to move the lock past such items. The slide lock assembly is versatile in that it can be placed in different orientations or attitudes and it includes an alignment element to enhance assembly of the lock to an object to be locked. An example of such an object is a telecommunication pedestal cover which is to be locked to a pedestal base. The slide lock assembly disclosed here is corrosion resistant and includes internal ports to drain away water and other contaminants should they enter the lock mechanism. Further, the slide lock assembly disclosed here is simply constructed, relatively inexpensive and very reliable.

A more complete understanding of the present invention and other objects, advantages and features thereof will be gained from a consideration of the following description of a preferred embodiment read in conjunction with the accompanying drawing provided herein. The preferred embodiment represents an example of the invention which is described here in compliance with Title 35 U.S.C. section 112 (first paragraph), but the invention itself is defined by the attached claims.

DETAILED DESCRIPTION OF A PREFERRED EMBODIMENT OF THE INVENTION

Figure 1:
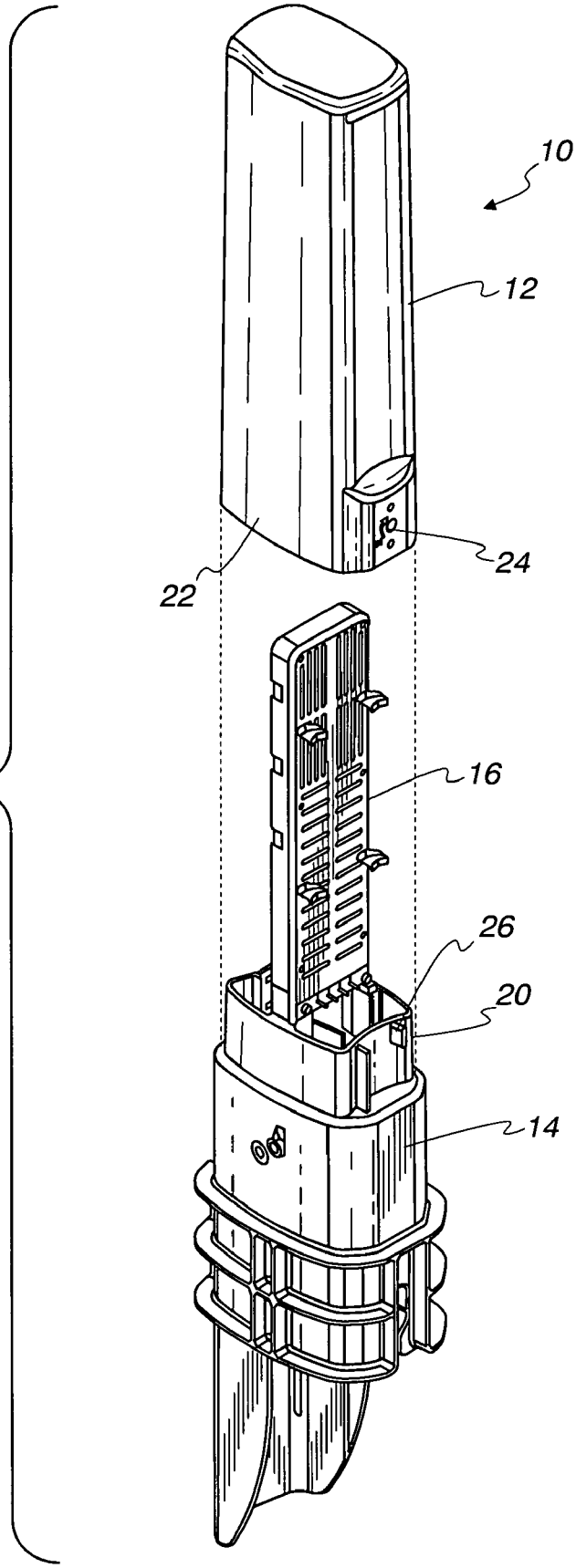
FIG. 1 is an exploded isometric view of a telecommunication pedestal closure assembly including a dome and a split base and having a slide lock assembly installed in the dome for engagement with the base.

While the present invention is open to various modifications and alternative constructions, the preferred embodiments shown in the various figures of the drawing will be described herein in detail. It is understood, however, that there is no intention to limit the invention to the particular embodiment, form or example which is disclosed here. On the contrary, the intention is to cover all modifications, equivalent structures and methods, and alternative constructions falling within the spirit and scope of the invention as expressed in the appended claims, pursuant to Title 35 U.S.C. section 112 (second paragraph).

Referring now to FIG. 1, there is illustrated a pedestal closure assembly 10 having a cover or dome 12, a base 14 and a mounting plate 16. The dome is shaped to telescope over an upper section 20 of the base 14 and to automatically lock itself to the base.

At a lower portion 22 of the dome, there is a bulge 24 behind which is a slide lock assembly to be described below. The slide lock assembly includes a slider which moves horizontally and is designed to engage or latch to a rib element 26 molded integrally with the base.

Figure 2:
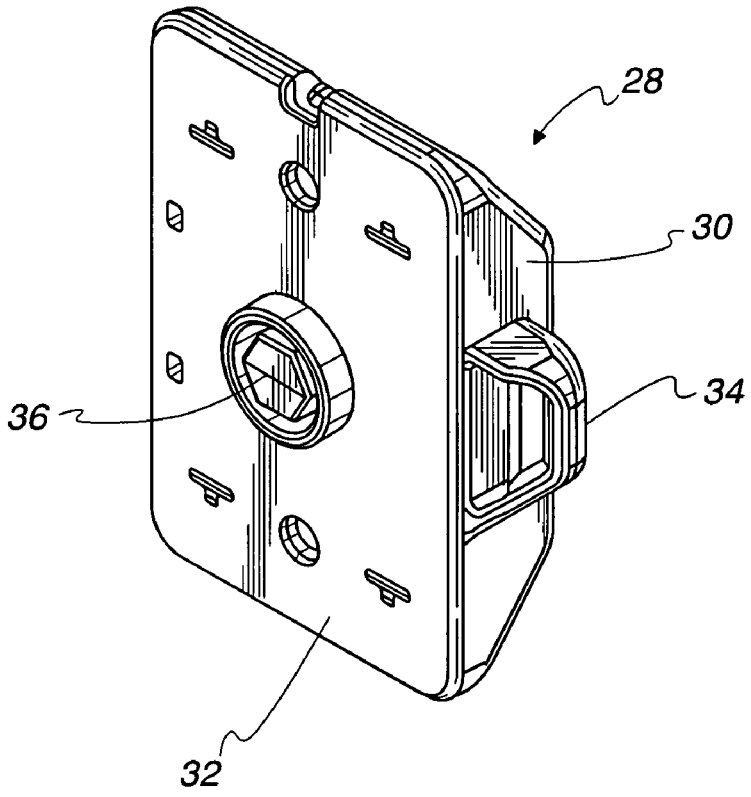
FIG. 2 is an enlarged front isometric view of the slide lock assembly of the type used in the pedestal assembly shown in FIG. 1.
Figure 3:
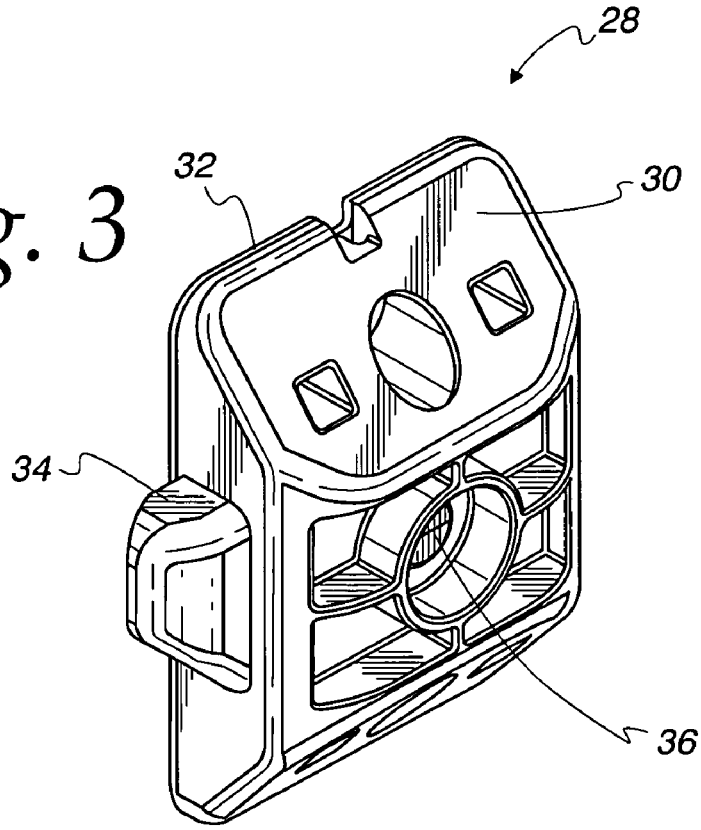
FIG. 3 is a rear isometric view of the slide lock assembly.
Figure 4:
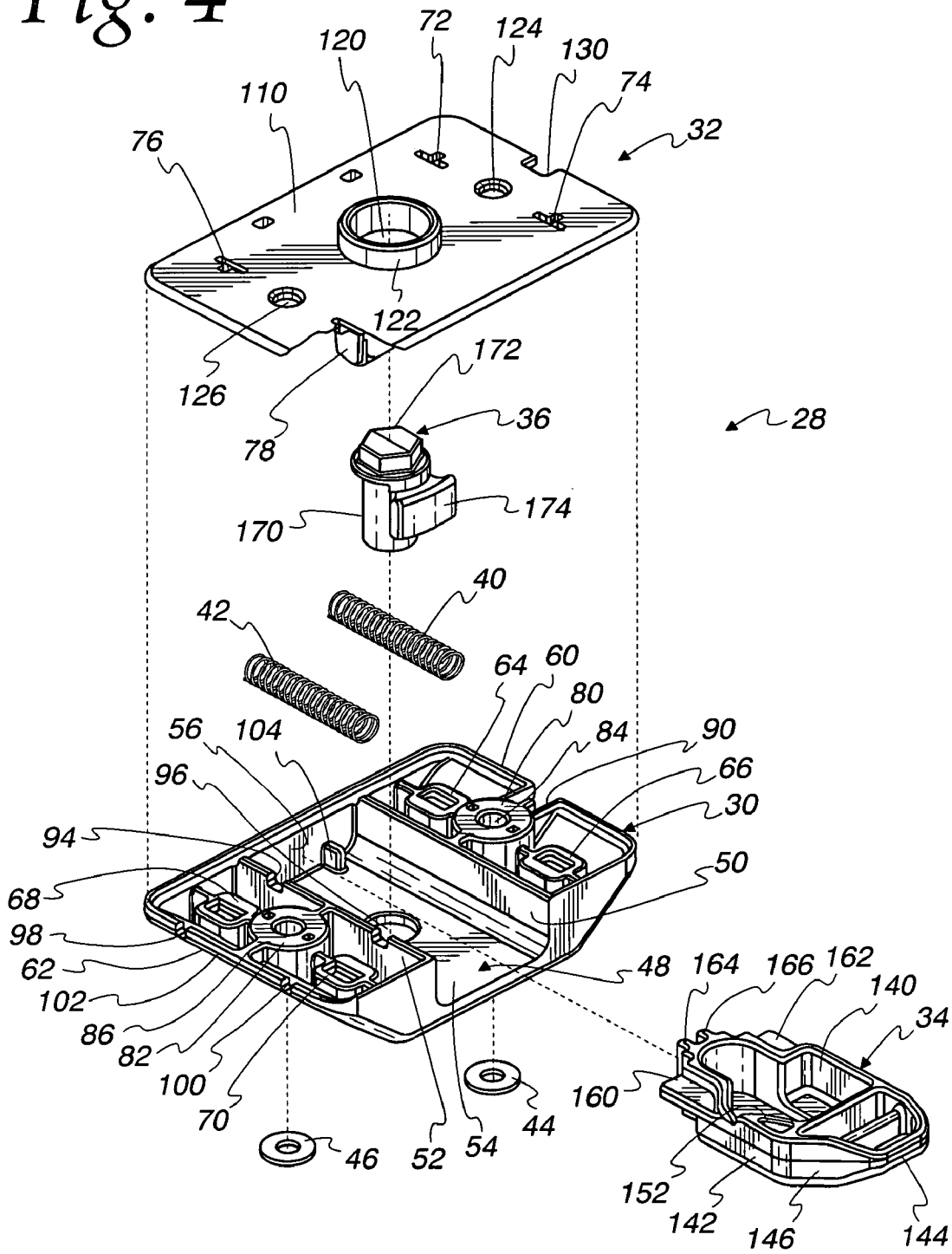
FIG. 4 is an exploded isometric view of the slide lock assembly.
Figure 5:
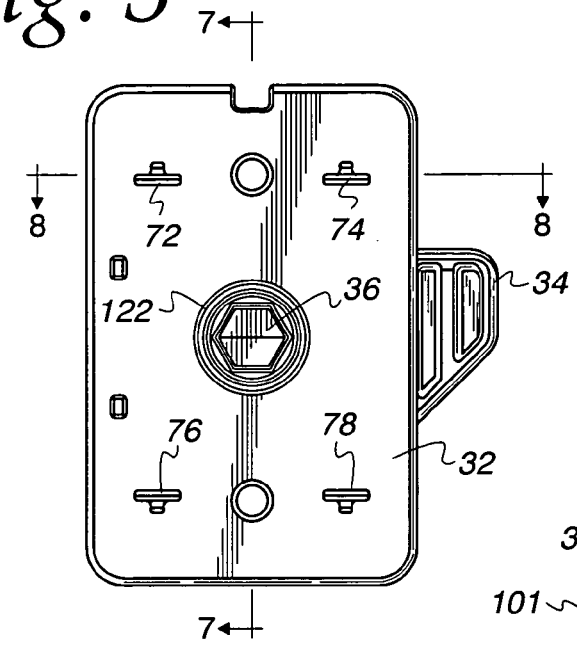
FIG. 5 is a front elevation view of the slide lock assembly.
Figure 6:
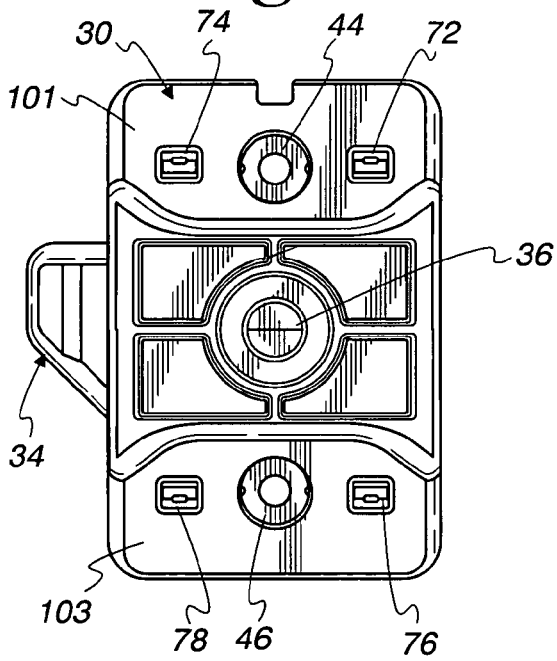
FIG. 6 is a rear elevation view of the slide lock assembly.
Figure 7:
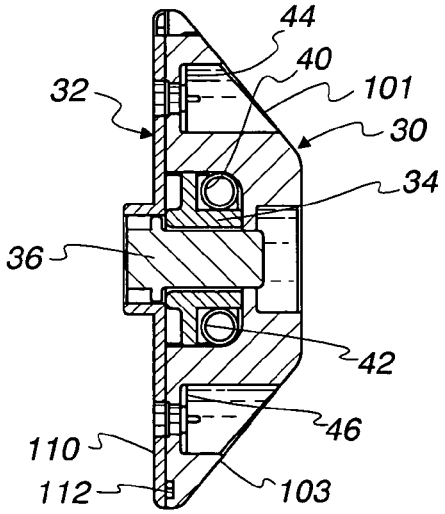
FIG. 7 is a sectional elevation view taken along line 7-7 of FIG. 5.
Figure 8:
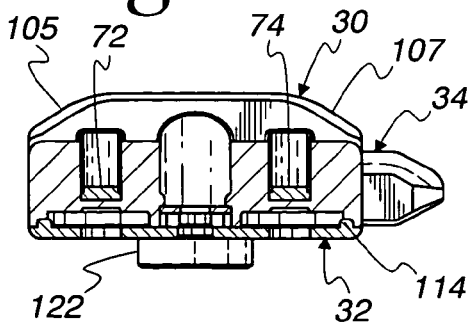
FIG. 8 is a sectional plan view taken along line 8-8 of FIG. 5.

Referring now to FIGS. 2, 3 and 4, the slide lock assembly 28 is illustrated. The assembly is mounted within the dome behind the bulge 24, FIG. 1. The slide lock is arranged in a compact unit and includes a base 30, a cover 32, the slider 34, a rotator, 36, a pair of springs 40, 42 and a pair of washers 44, 46.

As shown in FIGS. 2-8, the base 30 is a single molded element having a slide channel 48 formed by opposing lateral walls 50, 52, a rear wall 54 and a side wall 56. Toward each end portion 60, 62 of the base, there are a pair of generally rectangular cylinders 64, 66 and 68, 70 for receiving snap arms 72, 74, 76, 78 molded with the cover 32. Each snap arm extends outwardly and includes an enlarged extended end for causing an interference fit with the lock base 30. Between each pair of rectangular cylinders, there is a circular cylinder 80, 82 having an opening 84, 86 to receive a rivet (not shown). At the upper end portion 60 of the base is a key groove 90 that receives a tab connected to the item to be locked, such as the dome of a telecommunication pedestal closure, so as to facilitate alignment of the slide lock during assembly of the lock with the dome. Incorporated herein by reference is applicants' co-pending application Ser. No. 10/712,612 entitled "Improved Pedestal Closure Assembly", where details of the pedestal closure are disclosed.

The base 30 also includes a first pair of drain grooves 94, 96 in the lower lateral wall 52 of the slider channel 48 and a second pair of drain grooves 98, 100 in a lower periphery 102 of the base. A pair of small tabs 104, 106 extending from the rear and side walls are also provided to guide the placement of the compression springs and to maintain the springs in place.

The back of the base includes upper and lower slanted surfaces 101, 103 extending from the periphery at about forty to forty five degrees from a horizontal reference. Similarly, the side walls 105, 107 may extend vertically and then slant inwardly at about thirty to thirty five degrees from a horizontal reference. All intersections are rounded as shown. The purpose of the slanted surfaces and rounded corners is to do away with any sharp edges so as to avoid catching or snagging any wire or cable which may be attached to the mounting plate 16 in the interior of the pedestal. The dome and the slide lock assembly must pass the mounting plate when the dome is removed from or installed on the pedestal base.

The cover 32 includes a panel 110 having an inner ridge 112 that engages a complementary indentation 114 formed in the periphery of the base. The wall panel is connected to the four extending snap arms 72, 74, 76, 78, and has a central opening 120 with a security ring 122 and two rivet openings 124, 126. Like the base, the cover also includes a key groove 130 that aligns with the key groove 90 of the base when the cover and the lock base are attached.

The slider 34 includes opposite lateral walls 140, 142, an end wall 144 and an outer slanted cam follower wall 146. The slider also includes a central slot opening 150 and an internal slanted cam follower wall 152. The slider also includes two spring abutment walls 160, 162 and two motion limiting projections 164, 166.

The springs 40, 42 are located between the abutment walls 160, 162 of the slider and the base side wall 56 and are restrained by the base tabs 104, 106.

The base, the cover and the slider are all made of a suitable synthetic resin, such as Nylon 66, and each is molded as one integral element. The springs are made of corrosion resistant steel.

The slide lock assembly also includes the rotator 36. The rotator includes a central body 170, a hex shaped head 172 and a cam arm 174. The rotator is constructed of a suitable metal, such as zinc alloy AG40A per ASTM B86, also known as Zamak 3.1 finished with Chromate per Mil-C-17711 and tested per ASTM 8201.

The two reinforcing washers 44, 46, made of 300 series stainless steel, are also provided and fit around the base rivet openings 84, 86 so as to reinforce the connection between the slide lock assembly and the dome of the pedestal, for example.

Assembly of the slide lock parts is extremely easy and quickly performed. The slider is inserted in the slide channel of the base as are the two springs. The rotator is then positioned through the slider and the base and restrained. Thereafter, the cover is snap fitted to the lock base with the hex shaped head extending through the cover central opening.

Figure 9:
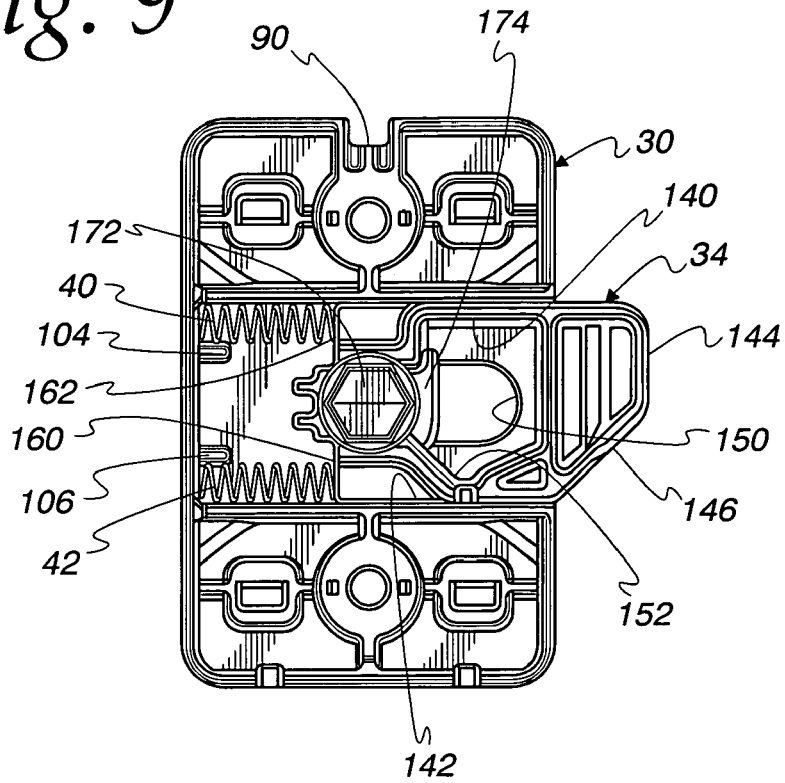
FIG. 9 is an elevation view of an uncovered slide lock assembly with a slider in an extended position.
Figure 10:
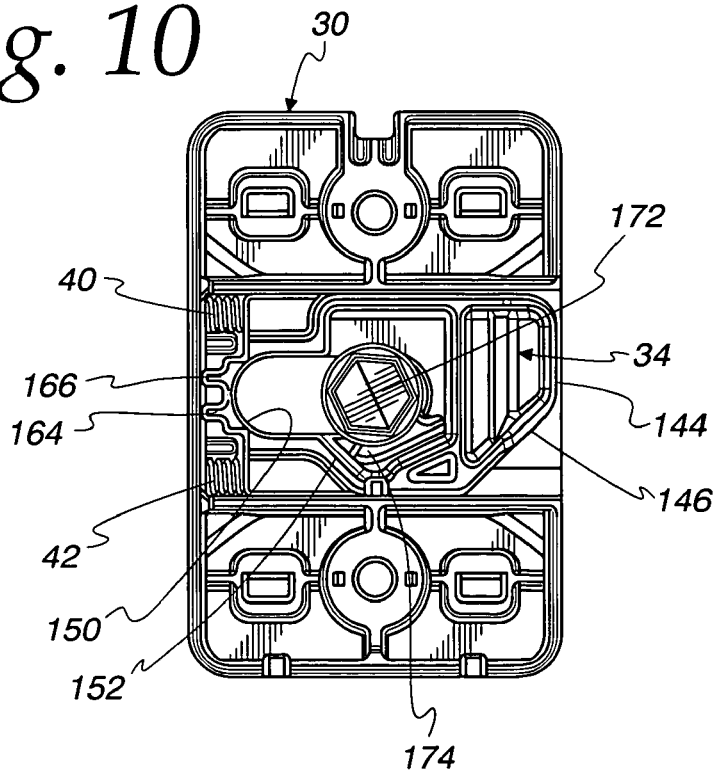
FIG. 10 is an elevation view like that shown in FIG. 9 but with the slider in a fully retracted position.

In operation, the compression springs bias the slider to the right as viewed in FIG. 9. However, when a technician inserts the proper tool, one with a hex opening over the hex head of the rotator and within the security ring, a ninety degree or quarter turn of the hex head causes the arm 174 of the rotator to act as a cam and push against the inner slanted wall 152 of the slider forcing the slider leftwardly to compress the springs as shown in FIG. 10. Thus, FIG. 9 illustrates the slider in its extended position and FIG. 10 illustrates the slider in its fully retracted position. When installed in the pedestal, for example, the outer slanted wall 146 of the slider will come into contact with the protruding rib 26 of the base 14 when the dome is being connected to the pedestal base. The upper surface of the rib acts as a cam to cause the slider to retract as the dome is moved downwardly into engagement. The rib causes the slider to fully retract so as to allow the slide lock to pass the rib. During engagement, after the slider is retracted, the end wall 144 of the slider will slide against the rib under the influence of the compressed springs which generate a biasing return force to the right. Once the slider has passed the rib, the biasing force of the springs will cause the slider to extend fully thereby creating an interference fit between the slider and the rib so as to lock the pedestal dome to the pedestal base.

Unlocking the dome and base merely requires the technician to insert the tool and rotate the tool in a clockwise direction to cam the slider out of engagement with the rib and thereby allow removal of the dome from the base.

It is to be understood that the slide lock assembly may be used in a different orientation. For example, the slide lock assembly might be oriented so that the slider faces downwardly or upwardly or to the left. Such a change of attitude may require a redesign of the slider so as to place the outer slanted wall in a location where it will make first contact with a projection on an object to which a connection is to be made.

It should also be understood that the rotator may have a different shape on its head or may even extend outwardly so as to be gripped by a user's fingers if desired.

The above specification describes in detail the preferred embodiment of the present invention. Other examples, embodiments, modifications and variations will, under both the literal claim language and the doctrine of equivalents, come within the scope of the invention defined by the appended claims. For example, the precise shape of the base and of the rotator may change but they will still be considered equivalent structures. Further, such changes will come within the literal language of the claims. Still other alternatives will also be equivalent as will many new technologies. There is no desire or intention here to limit in any way the application of the doctrine of equivalents nor to limit or restrict the scope of the invention.

The invention claimed is:

1. A slide lock assembly for an outdoor pedestal closure comprising:

a base connected to an interior portion of a dome of said pedestal closure, said base having a channel formed therein and an outer surface free of sharp edges;

a slider mounted in said channel of said base and movable along said channel between an extended position and a retracted position;

a rotator mounted to said base and connected to said slider for moving said slider to its retracted position;

drainage ports in communication with said channel; and a biasing element mounted between said base and said slider for pushing said slider to said extended position.

2. The assembly as claimed in claim 1 wherein:

said slider includes a cam follower wall and a cam follower surface for engaging said rotator.

3. The assembly as claimed in claim 1 wherein:

said rotator includes a body and an arm, said arm for acting as a cam when said body is rotated.

4. The assembly as claimed in claim 1 wherein:

said outer surface includes a smooth, slanted surface.

5. The assembly as claimed in claim 1 wherein:

said base includes an opening for receiving said rotator and a side wall; and said slider includes an elongated slot for receiving said rotator and an abutment wall.

6. The assembly as claimed in claim 5 including:

a cover, said cover having an opening for said rotator.

7. The assembly as claimed in claim 6 wherein:

said cover includes a snap arm for engaging said base; and said base includes a snap arm receiving opening.

8. The assembly as claimed in claim 7 wherein:

said biasing element is a compression spring mounted between said side wall of said base and said abutment wall of said slider.

9. The assembly of claim 1 wherein the outer surface includes a plurality of slanted surfaces.

10. The assembly of claim 9 wherein the plurality of slanted surfaces includes an upper surface and a lower surface.

11. The assembly of claim 10 wherein the plurality of slanted surfaces further includes at least two side walls.

12. The assembly of claim 11 wherein the outer surface further includes at least one rounded intersection.

13. The assembly of claim 12 wherein the outer surface further includes at least one rounded corner.

14. A pedestal closure assembly comprising:

a dome having a lower portion, an assembly base, and a lock, the lock including an interior portion positioned on an interior portion of the dome and adjacent cables when the cables are installed in the pedestal closure assembly, wherein the dome is configured to slide onto the assembly base, wherein said interior portion of the lock includes a snag-free lock base housing additional lock parts for securing the dome to the assembly base, and wherein the snag-free lock base is free of sharp edges so as to avoid snagging the cables when the dome is removed from or installed on the assembly base with the cables installed in the pedestal closure assembly.

15. The pedestal closure assembly of claim 14 wherein the snag-free lock base includes a plurality of slanted surfaces.

16. The pedestal closure assembly of claim 15 wherein the plurality of slanted surfaces includes an upper surface and a lower surface.

17. The pedestal closure assembly of claim 16 wherein the plurality of slanted surfaces further includes at least two side walls.

18. The pedestal closure assembly of claim 17 wherein the snag-free lock base further includes at least one rounded intersection.

19. The pedestal closure assembly of claim 18 wherein the snag-free lock base further includes at least one rounded corner.

20. The pedestal closure assembly of claim 14 further comprising a mounting plate for supporting cables.

21. The pedestal closure assembly of claim 20 wherein the snag-free lock base is positioned in close proximity to the mounting plate when the dome is removed from or installed on the assembly base.

22. The pedestal closure assembly of claim 21 wherein the lock is positioned on the lower portion of the dome.

* * * * *